US005082191A

United States Patent [19]

Wirz

[11] Patent Number: 5,082,191

[45] Date of Patent: Jan. 21, 1992

[54] METHOD OF, AND APPARATUS FOR, CHANGING BOBBINS IN AUTOMATIC WINDERS

[75] Inventor: Armin Wirz, Ossingen, Switzerland

[73] Assignee: Maschinenfabrik Rieter AG, Winterthur, Switzerland

[21] Appl. No.: 501,252

[22] Filed: Mar. 29, 1990

[30] Foreign Application Priority Data

Apr. 6, 1989 [CH] Switzerland ..... 01280/89

[51] Int. Cl.[5] ..... B65H 67/044

[52] U.S. Cl. ..... 242/1800 A; 242/180 DD

[58] Field of Search ..... 242/18 A, 18 R, 18 DD, 242/18 PW, 25 A

[56] References Cited

U.S. PATENT DOCUMENTS

| | | | |
|---|---|---|---|
| 4,487,374 | 12/1984 | Sugioka et al. | 242/18 A |
| 4,548,366 | 10/1985 | Wirz et al. | 242/18 DD |
| 4,552,313 | 11/1985 | Sasaki | 242/18 A |
| 4,765,552 | 8/1988 | Sugioka et al. | 242/18 R |
| 4,917,319 | 4/1990 | Lenk | 242/18 A |

FOREIGN PATENT DOCUMENTS

| | | |
|---|---|---|
| 0073930 | 3/1983 | European Pat. Off. . |
| 0080076 | 6/1983 | European Pat. Off. . |
| 0094483 | 11/1983 | European Pat. Off. . |
| 0182389 | 5/1986 | European Pat. Off. . |
| 0200234 | 12/1986 | European Pat. Off. . |
| 0254944 | 2/1988 | European Pat. Off. . |

*Primary Examiner*—Stanley N. Gilreath

*Attorney, Agent, or Firm*—Sandler, Greenblum & Bernstein

[57] ABSTRACT

For the loss-free or wasteless change of bobbins in an automatic winder comprising a contact roller and mandrel drive, there is selectively increased during the bobbin changing operation either the rotational speed of the mandrel drive for the bobbin mandrel supporting a package formed thereat, or the rotational speed of the contact roller relative to that of the winding operation. The increase in rotational speed in either case is effected after interruption of contact between the contact roller and the package.

5 Claims, 2 Drawing Sheets

METHOD OF, AND APPARATUS FOR, CHANGING BOBBINS IN AUTOMATIC WINDERS

BACKGROUND OF THE INVENTION

The present invention broadly relates to a method of continuously winding a yarn or the like on bobbins and automatically exchanging a full bobbin with an empty bobbin and pertains, more specifically, to a new and improved method of continuously winding at least one filament or thread and automatically changing bobbins in an automatic winder or winding machine having at least two bobbin mandrels, each provided with a self-contained drive, and a contact or friction drive roller which is in contact with a package being formed on one of the at least two bobbin mandrels during the normal winding operation. The contact or friction drive roller is also provided with a self-contained drive. The present invention also relates to a new and improved apparatus for performing the inventive method of continuously winding at least one filament or thread and automatically changing bobbins in an automatic winder or winding machine.

An automatic winder of this type for continuous loss-free or wasteless winding of monofilaments or multifilaments, particularly, but not exclusively, synthetic or man-made filaments, comprises at least two bobbin mandrels, one of which is used for winding the filament, while the other bobbin mandrel is held in a stand-by position so that the filament, subsequent to completing the package being wound on the first bobbin mandrel, can be transferred to the second bobbin mandrel to continue the filament winding operation, thus accomplishing the exchange of bobbins. In the case of high filament delivery speeds, for example, speeds above 4000 m/min., it can be advantageous to provide each bobbin mandrel with self-contained drive means, such drive means being a spindle drive or direct drive, i.e. surface drive of the package itself. Nevertheless, during the normal winding process, the filament travels around a so-called contact roller or friction drive roll and then onto the package of the bobbin mandrel in the operating or working position. This contact roller exercises a predetermined surface or contact pressure on the package being formed and possibly also serves as a guide for the filament or thread between a traverser or traverse device and the package, and/or supplies a signal representing the circumferential speed of the package to a control unit for the bobbin-mandrel drive.

During the normal winding process, i.e. the so-called winding travel, the contact or friction drive roller maintaining contact with the package being formed and the rotational speed of the contact or friction drive roller is controlled such that the circumferential speed of the contact or friction drive roller is maintained substantially equal to the linear delivery speed of the filament or thread. This contact between the contact or friction drive roller and the package is interrupted during the change of bobbins and must be restored subsequent to the bobbin change operation. A method pertinent thereto is described, for example, in U.S. Pat. No. 4,548,366, granted Oct. 22, 1985 of the assignee Rieter Machine Works Ltd., located in Winterthur, Switzerland, and in the cognate European Patent Application No. 0,182,389, published May 28, 1986 and in the further cognate European Patent Application No. 0,200,234, published Dec. 10, 1986.

The bobbin changing process is a delicate or critical operation which is particularly afflicted with the risk of a breakdown of the filament or thread tension. In order to reduce this risk, the circumferential speed of the full package during the change of bobbins in an automatic winder with spindle drive or direct drive can be readily maintained substantially constant subsequent to the interruption of contact between the contact or friction drive roller and this full package and until the filament or thread is transferred to the other bobbin mandrel. In this connection, reference is made, for example, to U.S Pat. No. 4,487,374, published Dec. 11, 1984 and the cognate European Patent No. 0,080,076, published June 1, 1983. However, in order to carry out the change of bobbins, it is necessary to interrupt the traverse motion of the filament or thread. This represents a reduction of the effective "receiving or take-up speed" for the filament or thread, this causing a corresponding reduction of the filament or thread tension. This effect or result has not been taken into account in the state-of-the-art.

SUMMARY OF THE INVENTION

Therefore, with the foregoing in mind, it is a primary object of the present invention to provide a new and improved method of, and apparatus for, continuously winding at least one filament or thread and automatically changing bobbins in automatic winders, which method and apparatus do not suffer from the aforementioned drawbacks and shortcomings of the prior art.

Another and more specific object of the present invention aims at providing a new and improved method of continuously winding at least one filament or thread and automatically changing bobbins in automatic winders, which method ensures that any undesired reduction of the filament or thread tension during the bobbin changing process and, accordingly, during the interruption of a traverse motion of the filament or thread is substantially precluded.

Now in order to implement these and still further objects of the present invention will become more readily apparent as the description proceeds, the method of continuously winding at least one filament or thread and automatically changing bobbins in an automatic winder or winding machine is manifested, among other things, by the steps of completing the package to provide a fully wound package at the end of the normal winding operation, interrupting the contact between the contact or friction drive roller and the fully wound package, suspending traverse motion of the at least one filament or thread, increasing the rotational speed of the one of the at least two bobbin mandrels supporting the fully wound package, and transferring the filament or thread to the other one of the at least two bobbin mandrels.

The step of increasing the rotational speed of the one bobbin mandrel supporting the fully wound package entails increasing the rotational speed of the one bobbin mandrel supporting the fully wound package until the step of transferring the filament or thread to the other one of the at least two bobbin mandrels is carried out.

The step of increasing the rotational speed of the one bobbin mandrel supporting the fully wound package until the filament or thread is transferred to the other one of the at least two bobbin mandrels entails continuously increasing the rotational speed of the one bobbin mandrel supporting the fully wound package.

Very heavy packages, for instance up to 50 kg, are produced nowadays, so that the inertia of the full package may prevent an adequate acceleration of the rotational speed of the full package even in the case of a reasonable output or drive capacity of the bobbin-mandrel drive motor.

A variant of the inventive method of continuously winding at least one filament or thread and automatically changing bobbins in an automatic winder or winding machine is manifested, among other things, by the steps of completing the package to provide a fully wound package at the end of the normal winding operation, interrupting the contact between the contact or friction drive roller and the fully wound package, suspending traverse motion of the at least one filament or thread, increasing the rotational speed of the contact or friction drive roller, and transferring the filament or thread to the other one of the at least two bobbin mandrels.

The method step of increasing the rotational speed of the contact or friction drive roller advantageously entails immediately increasing the rotational speed of the contact or friction drive roller after interrupting the contact between the contact or friction drive roller and the fully wound package.

As alluded to above, the invention is not only concerned with the aforementioned method of continuously winding at least one filament or thread and automatically changing bobbins in automatic winders, but also relates to a new and improved apparatus for performing and carrying out the inventive method.

Generally speaking, the aforenoted apparatus for continuously winding at least one filament or thread and automatically changing bobbins in an automatic winder comprises at least two bobbin mandrels, each provided with a self-contained drive, and a contact or friction drive roller. The at least one filament or thread performs a traverse motion during the normal winding operation and forms a package on one of the at least two bobbin mandrels. The contact or friction drive roller is in contact with the package during the normal winding operation and separated from the package during automatic bobbin changing, the contact or friction drive roller also having a self-contained drive.

An advantageous embodiment of the apparatus for continuously winding at least one filament or thread and constructed according to the invention, is manifested, among other things, by the features that control means are provided for each self-contained drive of the at least two bobbin mandrels, such control means controlling the self-contained drives of the at least two bobbin mandrels such that, during the bobbin changing operation, the rotational speed of the one of the at least two bobbin mandrels which supports the package is continuously increased subsequent to the separation of the contact or friction drive roller from the package and until the at least one filament or thread is transferred to the other one of the at least two bobbin mandrels.

A further advantageous embodiment of the apparatus constructed according to the invention comprises control means provided for the self-contained drive of the contact or friction drive roller, such control means controlling the self-contained drive of the contact or friction drive roller such that the rotational speed of the contact or friction drive roller is increased subsequent to the separation of the contact or friction drive roller from the package.

This increase in the rotational speed of the contact or friction drive roller can be carried out immediately subsequent to interruption of the contact between the full package and the contact or friction drive roller and, at least in comparison with an increase of the rotational speed of the full package, can be surgingly effected. The increase in the circumferential speed of the contact or friction drive roller assists in maintaining the filament or thread tension &n the filament or thread passage upstream of the contact or friction drive roller at a suitable level in spite of effective interruption of the operation of the traverser or traverse device. The increase in rotational speed of the contact or friction drive roller can be revoked after the traverser or traverser device resumes operation, but it ian prove advantageous not to immediately reduce the rotational speed of the contact or friction drive roller after resuming package formation, but only after a transition phase. During this transition phase, the filament or thread passage can again be stabilized after the "disturbances" of the bobbin changing process.

In certain cases, it can furthermore prove advantageous during the transition phase not to determine the rotational speed of the new package according to the control program of the normal winding process, i.e. of the winding travel, in spite of contact between the new package and the contact or friction drive roller, but rather to determine the rotational speed of the new package in conformity with the still increased rotational speed of the contact or friction drive roller, so that the normal control program for continuously reducing the rotational speed as a function of the formation of the package only takes effect at the end of the transition phase.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the apparatus for continuously winding at least one filament or thread and automatically changing bobbins in automatic winders has been illustrated therein as is needed to enable one skilled in the art to readily understand the underlying principles and concepts of this invention.

Figure 1A:
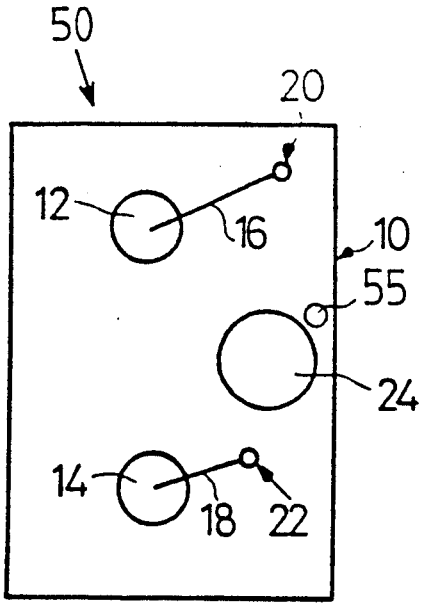
FIG. 1A PRIOR ART
FIG. 1A schematically shows an embodiment of a first automatic winder known to the art.

Turning attention now specifically to FIG. 1A of the drawings, an automatic winder or winding machine 50 illustrated therein is described in detail, for example, in European Patent No. 0,073,930, published Mar. 16, 1983 of the assignee Maschinenfabrik Rieter AG, located in Winterthur, Switzerland and, accordingly, is here only schematically outlined. A frame or housing 10 of this automatic winder or winding machine 50 supports two bobbin mandrels or chucks 12 and 14. These bobbin mandrels or chucks 12 and 14 are carried by respective swivel or swing or pivot arms 16 and 18 and are, therefore, pivotable about respective pivot or bearing axles 20 and 22 and between respective doffing or rest positions, as depicted in FIG. 1A, and respective operative or working or winding positions in which the package being formed on one of the bobbin mandrels or chucks 12 and 14 is in contact with a contact or friction drive roller 24. The filament or thread not particularly shown in the drawings is guided in operation by a suitable traverser or traverse device, generally indicated in FIG. 1A by reference numeral 55, onto the contact or friction drive roller 24 and from there to one of the two bobbin mandrels or chucks 12 and 14 which is located in its operative or working position, thus forming a package or a bobbin on the respective bobbin mandrel or chuck. For this purpose, each one of the two bobbin mandrels or chucks 12 and 14 is rotatably driven about its own longitudinal axis.

When the package reaches a predetermined size, for example, with regard to filament length or package diameter, a change of bobbins is carried out, whereby the first bobbin mandrel or chuck with the full package or bobbin is swiveled back into its doffing or rest position and the second bobbin mandrel or chuck is moved into the operating or working position. The second bobbin mandrel or chuck thereby takes over the filament or thread and continues the winding process without interruption, for which purpose the second bobbin mandrel or chuck must now rotate about its own longitudinal axis, whereas the first bobbin mandrel or chuck with the full package or bobbin must be stopped for doffing.

Figure 1B:
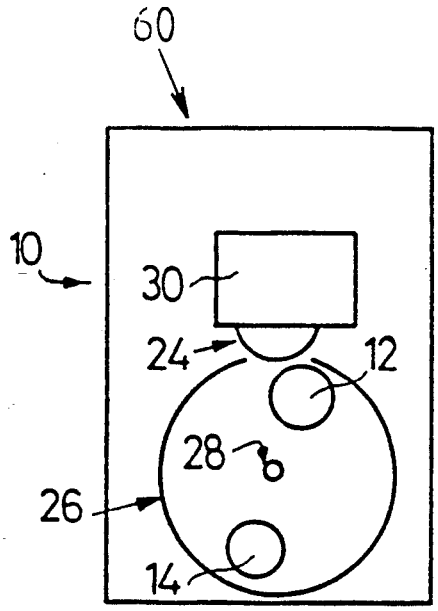
FIG. 1B PRIOR ART
FIG. 1B schematically shows an embodiment of a second automatic winder known to the art.

The automatic winder or winding machine 60 according to FIG. 1B is also in a position to carry out such a loss-free or wasteless bobbin changing process, for which purpose, however, the two bobbin mandrels or chucks 12 and 14 are not carried by respective swivel or swing arms, but rather conjointly supported at a turret or revolver head 26. This turret or revolver head 26 is rotatably mounted at the frame or housing 10 for rotation about an axle or shaft 28 such that the two bobbin mandrels or chucks 12 and 14 can be brought alternately from the doffing or rest position, which in FIG. 1B is occupied by the bobbin mandrel or chuck 14, into an operating or working or winding position and thus in contact with the contact or friction drive roller 24. This contact or friction drive roller 24 is carried by a carriage 30 which is elevationally movable.

Figure 2:
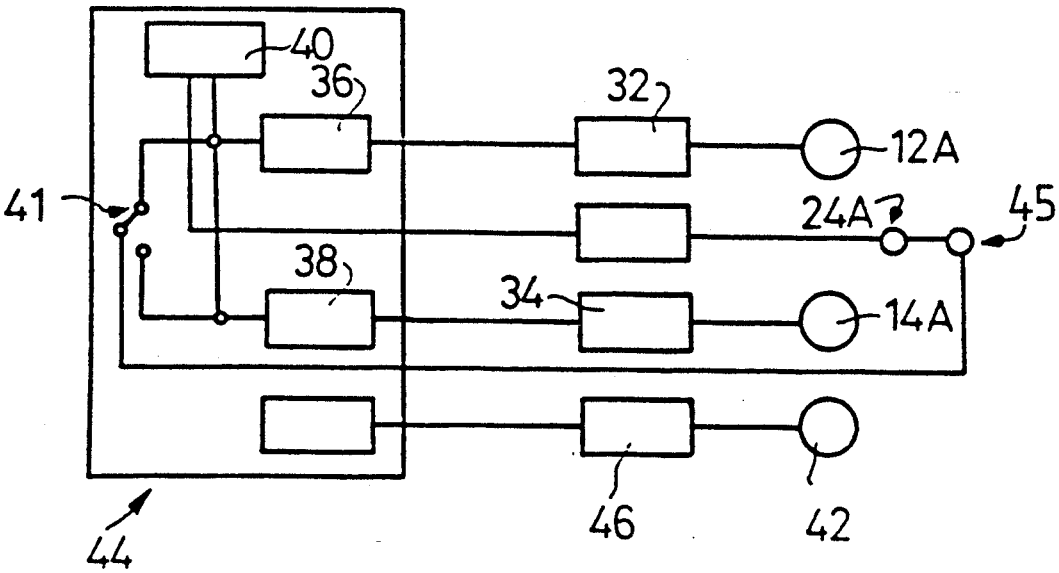
FIG. 2 schematically shows a block diagram of a control system to be employed with an automatic winder according to FIG. 1A or FIG. 1B.

FIG. 2 schematically shows a drive system having a corresponding control system, which drive system is suitable for both winder types 50 and 60, depicted in FIGS. 1A and 1B. A frequency controlled electric drive or driving motor conveniently designated by reference numeral 12A is directly coupled with the first bobbin mandrel or chuck 12 and can drive the latter during and subsequent to the winding travel. Reference numerals 14A and 24A designate suitable drive or driving motors for the second bobbin mandrel or chuck 14 and the contact or friction drive roller 24, respectively. The drive of driving motor 24A is also connected to a tachometer signal generator 45, which generates or produces a signal representing the rotational speed of the contact or friction drive roller 24.

The frequency controlled electric drive or driving motors 12A and 14A are supplied with energy by means of respective frequency converters 32 and 34, whereby the momentary supply frequency is determined by respective control units 36 and 38. Both control units 36 and 38 receive a reference or set value signal from a common adjustable reference or set point value generator 40. During the so-called winding travel, the operating control unit 36 or 38, i.e. the control unit of the winding mandrel or chuck 12 or 14 in the operative or working or winding position, receives an actual or instantaneous value signal from the tachometer signal generator 45 via switching means 41 which changes over during the bobbin changing process.

The traverser or traverse device 55 schematically shown in FIG. 1A, is conveniently indicated in FIG. 2 by its drive or driving motor 42 which by means of a frequency converter 46 is also frequency controlled by a controller or controlling apparatus 44 containing the control units 36 and 38. During operation, the filament or thread is shifted to-and-fro along the respective mandrel or chuck axis by the traverser or traverse device, in order to render possible the desired package formation. By suitably controlling the rotational speed of the drive or driving motor 42 for the traverser or traverse device relative to the controlled rotational speed of the frequency controlled electric drive or driving motors 12A and 14A, respectively, there can be formed, for example, a so-called random cross winding or a precision bobbin or a step precision winding.

For the automatic winder or winding machine 50 according to FIG. 1A, the control system of the drive system basically corresponds with the control system described, for example, in the aforementioned European Patent Application No. 0,182,389, published May 28, 1986 and in European Patent Application No. 0,094,483, published Nov. 23, 1983.

For the automatic winder or winding machine 60 according to FIG. 1B, the control system of the drive system basically corresponds with the system described, for example, in U.S. Pat. No. 4,765,552, granted Aug. 23, 1988.

Figure 3:
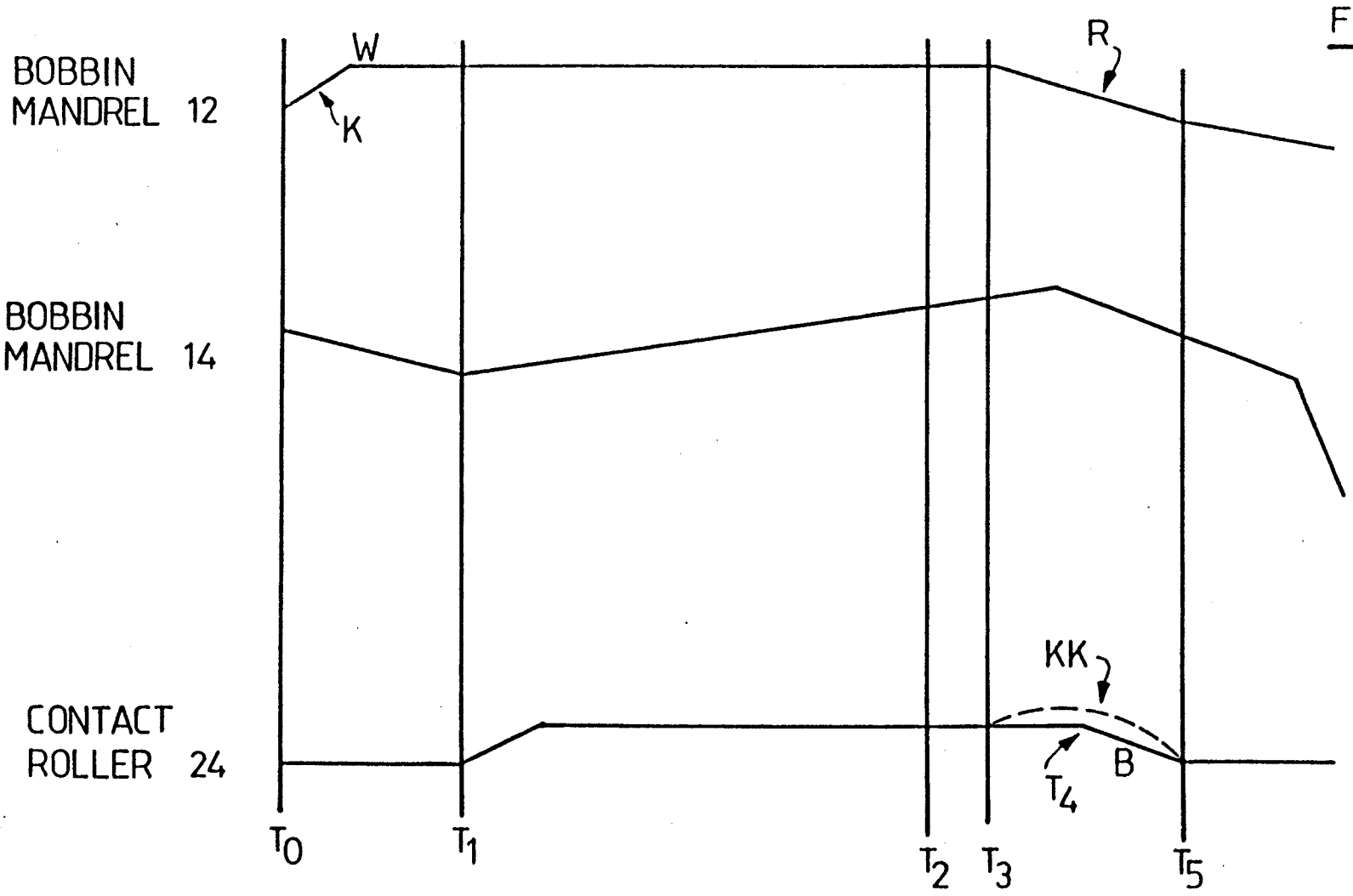
FIG. 3 schematically shows a flow diagram or timing chart of a so-called bobbin changing process which can be carried out by the control system depicted in FIG. 2.

The sequence and timing of the bobbin changing process is schematically shown in FIG. 3. This flow diagram or timing chart represents the conditions of the first bobbin mandrel or chuck 12 and its drive or driving motor 12A, the second bobbin mandrel or chuck 14 and its drive or driving motor 14A, and the contact or friction drive roller 24 and its drive or driving motor 24A, and illustrates the temporal variation of rotational speed with respect to time plotted on the abscissa or horizontal axis. At the moment of time $T_0$, the filament or thread is forming a package on the second bobbin mandrel or chuck 14, whereby the rotational speed of the frequency controlled electric drive or driving motor 14A must be continuously reduced in the course of the winding travel, in order to take into account the continuously increasing diameter of this package at a constant filament or thread delivery speed. This winding operation of the frequency controlled electric drive or driving motor 14A is controlled by the control unit 38 by comparing the actual value with the reference value, since the package is continuously in contact with the contact or friction drive roller 24, so that the tachometer signal generator 45 provides a feedback signal.

However, since this package is approaching the predetermined filament length thereof or the predetermined package diameter, the bobbin mandrel or chuck 12 at the moment of time $T_0$ is set in rotary motion, for which purpose the frequency controlled electric drive or driving motor 12A is frequency controlled by the reference or desired or set value generator 40 via the control unit 36, in order to perform or fulfil a predetermined acceleration curve K for acceleration to normal speed. This acceleration to normal speed is only open-loop controlled and not automatically controlled, since no feedback signal is generated for the bobbin mandrel or chuck 12.

At the moment of time $T_0$, the contact or friction drive roller 24 is driven at a constant rotational speed which corresponds to the linear delivery speed of the filament or thread. Although not particularly shown in the drawings, the drive or driving motor 42 of the traverser or traverse device is also driven at a constant speed. The state of this drive or driving motor 42 is not shown in FIG. 3, because there is no change during the sequence of the bobbin changing process.

At the moment of time $T_1$, the package attains the predetermined reference or desired dimension and a change of bobbins is initiated. The empty bobbin mandrel or chuck 12 has already reached a rotational speed W for bobbin changeover. This rotational speed W can represent a slightly excessive speed or overspeed in relation to the linear delivery speed of the filament or thread. The filament or thread tension can thus be maintained during the filament transfer phase. Normal winding of the filament or thread on the bobbin mandrel or chuck 14 is now suspended in that the bobbin mandrel or chuck 14 is suddenly moved away from the contact or friction drive roller 24. Nevertheless, the filament or thread is still taken up at the same bobbin mandrel or chuck 14, since the filament transfer has not yet taken place.

With the interruption of the normal winding process, the control loop by means of the contact or friction drive roller 24 is also interrupted, so that the controller or controlling apparatus 44 can now only exercise an open-loop control function with respect to the frequency controlled electric drive or driving motor 14A. After the moment of time $T_1$, this open-loop control brings about a slight acceleration of the rotational speed of the frequency controlled electric drive or driving motor 14A and thus of the bobbin mandrel or chuck 14 with the full package, in order to increase the effective winding speed and to maintain the filament or thread tension. At the same time, the controller or controlling apparatus 44 effects, for the same purpose, an acceleration of the drive or driving motor 24A of the contact or friction drive roller 24. After a short period of acceleration, the rotational speed of the contact or friction drive roller 24 is again stabilized at a higher level. The frequency controlled electric drive or driving motor 14A of the bobbin mandrel or chuck 14 with the full package is further relatively slowly accelerated also subsequent to terminating the rotational-speed increase of the contact or friction drive roller 24, so that the filament or thread is held taut during the change of bobbins and during filament transfer.

The filament or thread is caught by the bobbin mandrel or chuck 12 at the moment of time $T_2$ and thus transferred. Details of the filament transfer are known from prior art literature and thus will not be repeated here. However, it is assumed that the bobbin mandrel or chuck 12 is not in contact with the contact or friction drive roller 24 when catching the filament or thread. The traverse motion of the filament or thread must be stopped before the moment of time $T_2$. As is known, this is not brought about by controlling the drive or driving motor 42 of the traverser or traverse device, but rather by lifting the filament or thread out of the filament or thread guide. In any case, at the time of filament transfer, only a ridge or bead of parallel windings, instead of cross windings, is formed on the full package at the bobbin mandrel or chuck 14. The suspension of traverse motion represents a particularly delicate step, because the risk of filament tension collapsing during this step is relatively great. The increased speed, i.e. the speed boost, of the contact or friction drive roller 24, the still slightly increasing rotational speed of the package on the bobbin mandrel or chuck 14 and possibly a slight overspeed of the bobbin mandrel or chuck 12 should all contribute to limit the effect of the suspension of the traverse motion.

At the moment of time $T_3$, the bobbin mandrel or chuck 12 with the captured filament or thread comes into contact with the contact or friction drive roller 24 which is still driven at an increased rotational speed, the rotational speed of the contact or friction drive roller 24 being adapted to the rotational speed of the controlled bobbin mandrel or chuck 12. The tachometer signal generator 45 now again delivers a feedback signal, which is used for controlling the rotational speed of the bobbin mandrel or chuck 12, which rotational speed now declines along a predetermined "ramp" R. The rotational speed of the bobbin mandrel or chuck 12 is thus slowed down, because the diameter or the new package is building up. However, the deceleration until the end of the predetermined "ramp" R at the moment of time $T_5$ is steeper than the deceleration during the normal winding operation which comes into effect after the moment of time $T_5$. The predetermined "ramp" R is retained until the filament or thread is again stabilized. In this period or interval $T_3$ through $T_5$ the traverse motion is again resumed, which can bring about a filament tension peak.

The controller or controlling apparatus 44 determines the relatively high rotational speed for the contact or friction drive roller 24 until a predetermined adjustable moment of time $T_4$ between the moments of time $T_3$ and $T_5$.

After the moment of time $T_4$, the controller or controlling apparatus 44 also determines a deceleration B for the contact or friction drive roller 24 until the moment of time $T_5$, when the contact or friction drive roller 24 is again driven at the operational or normal rotational speed. However, the effective speed of the contact or friction drive roller 24 is only partly determined by the controller 44 between the moments of time $T_3$ and $T_5$. In practice, this rotational speed of the contact roller 24 follows a curve KK depicted in broken lines and which is also influenced by the transmission of a torsional moment from the bobbin mandrel or chuck 12. The deceleration phase B is selected such that the contact or friction drive roller 24 at the moment of time $T_5$ operates at the desired operational speed, so that at this moment of time $T_5$ normal operating conditions prevail, both for the mandrel or chuck 12 as well as for the contact or friction drive roller 24.

After the moment of time $T_4$, the bobbin mandrel or chuck 14 follows a more or less predetermined braking curve which, for reasons of safety, is initiated only after the moment of time $T_5$. Since this braking curve is of no relevance to the invention, it is here not further described.

It is readily conceivable that each bobbin mandrel or chuck can process more than one filament or thread at the same time and form respective packages.

It is already known to carry out an increase in the rotational speed of the contact or friction drive roller 24 during the change of bobbins by a so-called friction roller drive. In this case, the bobbin mandrel or chuck and the package are driven by the contact or friction drive roller and the increase in rotational speed should bring about a higher rotational speed of the package during the changeover process. However, in the case of the bobbin mandrel or chuck drive, the contact or friction drive roller 24 has no influence on the rotational speed of the respective bobbin mandrel or chuck during the change of bobbins, since even the feedback signal is no longer delivered after the interruption of contact between the contact or friction drive roller 24 and the full package.

The sequence of the bobbin changing steps and the temporal conditions thereof are determined by a programmable control in the controller or controlling apparatus 44. Such programmable controls are known and, therefore, are not described here. They can be partly dependent upon time or timing signals and partly upon sensors for already performed steps.

If the traverse motion of the filament or thread can be maintained after the interruption of contact between the full package and the contact or friction drive roller 24, then the package diameter will also increase during the changeover operation. This would lead to an increase in filament or thread tension even without accelerating the rotational speed of the package. Under these circumstance, it can be sufficient to maintain the rotational speed of the package after interruption of contact with the contact or friction drive roller 24, instead of increasing the rotational speed of the package as shown in FIG. 3.

If, in addition, the change of bobbins takes a relatively long time, for example, because of slow rotational movement of the turret or revolver head 26, then the increase in package diameter in the event of continued traverse motion of the filament or thread can be so large that a slight decrease in of the rotational speed of the full package is necessary, in order to avoid excessive filament or thread tension.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of continuously winding at least one filament and automatically changing bobbins in an automatic winder having at least two bobbin mandrels, each provided with a self-contained drive, and a contact roller which is in contact with the package being formed on one of the at least two bobbin mandrels during a normal winding operation, such contact roller being provided with a self-contained drive, comprising the steps of:

winding at least one filament onto one of the at least two bobbin mandrels during the normal winding operation;

traversing the at least one filament during the winding;

completing the package to provide a fully wound package at the end of the normal winding operation;

interrupting the contact between the contact roller and the fully wound package;

suspending traverse motion of the at least one filament;

increasing the rotational speed of the contact roller; and transferring the at least one filament to the other one of the at least two bobbin mandrels.

2. The method as defined in claim 1, wherein:

said step of increasing the rotational speed of the contact roller entails immediately increasing the rotational speed of the contact roller after the step of interrupting the contact between the contact roller and the fully wound package.

3. The method as defined in claim 1, further comprising, during the step of increasing the rotational speed of the contact roller, the step of:

increasing the rotational speed of said one of the at least two bobbin mandrels.

4. An apparatus for continuously winding at least one filament and automatically changing bobbins in an automatic winder, comprising:

at least two bobbin mandrels;

each one of said at least two bobbin mandrels being provided with a self-contained drive;

means for traversing the at least one filament;

the at least one filament performing a traverse motion by means of said means for traversing and forming a package on one of said at least two bobbin mandrels;

a contact roller having a self-contained drive and being in contact with said package being formed at said one of said at least two bobbin mandrels during a normal winding operation and being separated from said package during automatic bobbin changing;

control means provided for said self-contained drive of said contact roller; and said control means controlling said self-contained drive of said contact roller such that the rotational speed of said contact roller is increased subsequent to said separation of said contact roller from said package.

5. An apparatus for continuously winding at least one filament and automatically changing bobbins in an automatic winder, comprising:

at least two bobbin mandrels;

each one of said at least two bobbin mandrels being provided with a self-contained drive;

means for traversing the at least one filament;

the at least one filament performing a traverse motion by means of said means for traversing and forming a package on one of said at least two bobbin mandrels;

a contact roller having a self-contained drive and being in contact with said package being formed at said one of said at least two bobbin mandrels during a normal winding operation and being separated from said package during automatic bobbin changing;

control means provided for said self-contained drive of said contact roller and said self-contained drive of said one of said at least two bobbin mandrels; and said control means controlling said self-contained drive of said contact roller and said self-contained drive of said one of said at least two bobbin mandrels such that the respective rotational speeds of said contact roller and said one of said at least two bobbin mandrels are increased subsequent to said separation of said contact roller from said package.

* * * * *